US010730090B2

(12) United States Patent
Nakagawa et al.

(10) Patent No.: US 10,730,090 B2
(45) Date of Patent: Aug. 4, 2020

(54) METHOD FOR FORMING BLANK AND METHOD FOR DETERMINING PREFORMING SHAPE

(71) Applicant: JFE STEEL CORPORATION, Tokyo (JP)

(72) Inventors: Kinya Nakagawa, Fukuyama (JP); Yasuhiro Kishigami, Chiba (JP); Yuji Yamasaki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 638 days.

(21) Appl. No.: 14/903,818

(22) PCT Filed: Jul. 8, 2014

(86) PCT No.: PCT/JP2014/003620
§ 371 (c)(1),
(2) Date: Jan. 8, 2016

(87) PCT Pub. No.: WO2015/004908
PCT Pub. Date: Jan. 15, 2015

(65) Prior Publication Data

US 2016/0160311 A1 Jun. 9, 2016

(30) Foreign Application Priority Data

Jul. 9, 2013 (JP) ..... 2013-143748
Mar. 28, 2014 (JP) ..... 2014-068717
Mar. 28, 2014 (JP) ..... 2014-068718

(51) Int. Cl.
*B21D 31/00* (2006.01)
*B21D 5/00* (2006.01)
(Continued)

(52) U.S. Cl.
CPC ..... *B21D 5/006* (2013.01); *B21D 31/00* (2013.01); *B21D 22/20* (2013.01); *B21D 22/26* (2013.01)

(58) Field of Classification Search
CPC ..... B21D 5/01; B21D 5/006; B21D 31/00; B21D 31/005; B21D 37/08; B21D 11/02; B21D 11/20
See application file for complete search history.

(56) References Cited

U.S. PATENT DOCUMENTS 8,091,201 B2 * 1/2012 Johnson ..... B21D 5/015 72/349
2005/0199032 A1 * 9/2005 Krajewski ..... B21D 22/022 72/379.2
(Continued)

FOREIGN PATENT DOCUMENTS

CN 101372024 A 2/2009
CN 102665957 A 9/2012
(Continued)

OTHER PUBLICATIONS

International Search Report for International Application No. PCT/JP2014/003620 dated Oct. 14, 2014.
(Continued)

*Primary Examiner* — Pradeep C Battula
(74) *Attorney, Agent, or Firm* — RatnerPrestia

(57) ABSTRACT

Provided is a method for forming a blank, the method being capable of improving both yields and formability. The method for forming a blank 1 includes forming the blank 1 into a preforming shape by plastic deformation and then plastically deforming the blank 1 from the preforming shape into a final shape. The preforming shape is determined so that, in each of cross sections in the final shape, the ratio (L1/L0) of a cross-sectional line length L1 in the preforming
(Continued)

shape to a cross-sectional line length L0 in the final shape in the same cross section position falls within a predetermined tolerance range.

10 Claims, 11 Drawing Sheets

(51) Int. Cl.
*B21D 22/20* (2006.01)
*B21D 22/26* (2006.01)

(56) References Cited

U.S. PATENT DOCUMENTS

| | | | | |
|---|---|---|---|---|
| 2009/0126448 | A1 | 5/2009 | Komatsu | |
| 2009/0272171 | A1* | 11/2009 | Golovashchenko ... | B21D 22/24 72/348 |
| 2011/0179846 | A1* | 7/2011 | Golovashchenko ... | B21D 37/08 723/347 |
| 2012/0204619 | A1 | 8/2012 | Maeda | |
| 2014/0182349 | A1 | 7/2014 | Yonemura | |

FOREIGN PATENT DOCUMENTS

| | | |
|---|---|---|
| EP | 0684183 | 11/1995 |
| JP | 200798443 | 4/2007 |
| JP | 2007118021 | 5/2007 |
| JP | 2007326112 | 12/2007 |
| JP | 2009104456 | 5/2009 |
| JP | 201145905 | 3/2011 |
| JP | 2011206789 A | 10/2011 |
| WO | 2012161050 | 11/2012 |

OTHER PUBLICATIONS

Written Opinion of the International Searching Authority for International Application No. PCT/JP2014/003620.
Chinese Office Action with partial English language translation for Application No. 201480038949.9, dated Aug. 7, 2017, 7 pages.
Korean Office Action with partial English language translation for Application No. 2016-7003309, dated Apr. 3, 2017, 6 pages.
Chinese Office Action with partial English language translation for application No. 201480038949.9, dated Nov. 1, 2016, 16 pages.
Supplementary European Search Report for EP 14823787.8, dated Jun. 7, 2016, 5 pages.
European Communication for European Application No. 14 823 787.8, dated Feb. 5, 2019, 5 pages.

* cited by examiner (a)

(b)

METHOD FOR FORMING BLANK AND METHOD FOR DETERMINING PREFORMING SHAPE

CROSS REFERENCE TO RELATED APPLICATIONS

This is the U.S. National Phase application of PCT/JP2014/003620, filed Jul. 8, 2014, which claims priority to Japanese Patent Application No. 2013-143748, filed Jul. 9, 2013, Japanese Patent Application No. 2014-068717, filed Mar. 28, 2014 and Japanese Patent Application No. 2014-068718, filed Mar. 28, 2014, the disclosures of each of these applications being incorporated herein by reference in their entireties for all purposes.

TECHNICAL FIELD OF THE INVENTION

The present invention relates to a technology of performing plastic deformation on a blank, such as stretch forming, in multiple stages to form the blank into a final shape.

BACKGROUND OF THE INVENTION

When a blank is formed into a final shape by press forming, an improvement of yields or an improvement of formability is an important issue.

Generally, to improve yields, it is preferable to adjust the forming conditions to as close as the conditions for stretch forming by minimizing the flow rate at which a material flows into a mold set during forming. However, an excessively low flow rate of the material would cause a shortage of the material in the mold set during forming, whereby the blank would be excessively thin and would have defects such as cracks. When, on the other hand, forming mainly including drawing were performed in order to prevent cracks, yields would be lowered. In order to address such problems, various measures have been taken thus far.

Patent Literature 1 has disclosed a method for improving yields by reducing excess metal as a result of reserving, in the early stage of press forming, a range in which a blank is not restrained. Patent Literature 2, on the other hand, has disclosed a method for preventing forming defects by allowing a local area of a press die set to drive as an individual movable punch and performing forming using the movable punch after placing a blank in the mold set in advance.

CITATION LIST

Patent Literature

PTL 1: Japanese Unexamined Patent Application Publication No. 2007-118021

PTL 2: Japanese Unexamined Patent Application Publication No. 2007-326112

SUMMARY OF THE INVENTION

The method disclosed in Patent Literature 1 is capable of reducing excess metal compared to an existing method but still needs some excess metal. Moreover, the method disclosed in Patent Literature 1 is drawing and thus yields or promise of improvement is/are limited.

The method disclosed in Patent Literature 2 is capable of preventing forming defects. The method, however, is drawing, so that yields are lowered.

Aspects of the invention focus on the above-described points and aims to provide a method for forming a blank, the method being capable of improving both yields and formability, and a method for determining a preforming shape.

Solution to Problem

It is generally known that the formability is improved when press forming is divided into multiple forming steps and is performed in multiple stages. This is because, in contrast to the case where a blank is formed into a final shape with one forming step, in the case where forming is performed stepwise in multiple forming steps, strain is prevented from being localized at a portion and easily dispersed throughout the blank. However, the shape of the die set used at the preforming stage preceding the final stage of press working largely depends on the experience of technical experts and the method for determining the shape has not be established.

The inventors have studied to find effective preforming in order to solve both requirements of yield improvement and formability improvement. The inventors have found that, as long as a cross-sectional line length approximately the same as that of the final shape is acquired in the preforming stage, a final shape that has substantially the same strain distribution as that at the time of preforming can be acquired at the time of final forming.

In order to solve the problems, a method for forming a blank according to an aspect is a method for forming a blank by forming the blank into a preforming shape by plastic deformation and then by plastically deforming the blank into a final shape from the preforming shape. The method includes determining the preforming shape so that, in each of cross sections taken at a plurality of positions in the final shape, a ratio of a cross-sectional line length in one of the cross sections in the preforming shape to a cross-sectional line length in the same cross section in the final shape falls within a predetermined tolerance range.

A method for determining a preforming shape according to another aspect is a method for determining a preforming shape of a blank in a case where the blank, after being formed into the preforming shape by plastic deformation, is plastically deformed into a final shape from the preforming shape. The method includes determining the preforming shape so that, in each of cross sections taken at a plurality of positions in the final shape, a ratio of a cross-sectional line length in one of the cross sections in the preforming shape to a cross-sectional line length in the same cross section in the final shape falls within a predetermined tolerance range.

Here, the positions of multiple cross sections are determined so as to be taken, for example, in a grid-like form or in a radial form.

In order to solve the problems, a method for forming a blank according to an aspect of the invention is a method for forming a blank including determining, when the blank, after being formed into a preforming shape by plastic deformation, is plastically deformed into a final shape from the preforming shape, the preforming shape so that a ratio of a second line length to a first line length falls within a predetermined tolerance range. An internal reference point is determined in a forming area of the final shape and a plurality of external reference points are determined on a peripheral border line of the forming area. In the final shape, a plurality of cross-sectional lines individually connecting a first internal point corresponding to the internal reference point to first external points corresponding to the external reference points are determined, division points at which the determined cross-sectional lines are divided at a predetermined set ratio are calculated, and a length of an endless annular line formed by connecting adjacent ones of the division points together is determined as the first line length. In the preforming shape, a length of an endless annular line formed by connecting together adjacent ones of division points, at which a plurality of cross sections are divided at the predetermined set ratio, are determined as the second line length, the plurality of cross sections individually connecting a second internal point corresponding to the internal reference point and second external points corresponding to the external reference points.

A method for determining a preforming shape according to another aspect of the invention is a method for determining a preforming shape of a blank in a case where the blank, after being formed into the preforming shape by plastic deformation, is plastically deformed into a final shape from the preforming shape. The method includes determining the preforming shape so that a ratio of a second line length to a first line length falls within a predetermined tolerance range. An internal reference point is determined in a forming area of the final shape and a plurality of external reference points are determined on a peripheral border line of the forming area. In the final shape, a plurality of cross-sectional lines individually connecting a first internal point corresponding to the internal reference point to first external points corresponding to the external reference points are determined, division points at which the determined cross-sectional lines are divided at a predetermined set ratio are calculated, and a length of an endless annular line formed by connecting adjacent ones of the division points together is determined as the first line length. In the preforming shape, a length of an endless annular line formed by connecting together adjacent ones of division points, at which a plurality of cross sections are divided at the predetermined set ratio, are determined as the second line length, the plurality of cross sections individually connecting a second internal point corresponding to the internal reference point and second external points corresponding to the external reference points.

According to an aspect of the present invention, as a result of acquiring at a preforming stage a cross-sectional line length that is approximately equivalent to that of a final shape, a final shape having substantially the same strain distribution as that of the time of preforming can be acquired at the time of final forming. Thus, the aspect of the present invention can provide a method for forming a blank and a method for determining a preforming shape that can achieve both of yield improvement and formability improvement.

Aspects of the invention are particularly effective for stretch forming.

For example, when press forming is adopted as an example of forming and aspects of the invention are applied to press forming, high yields can be achieved and stretch forming is easily performed at the time of press forming.

In stretch forming performed using a punch and a die, when a blank is formed into a final shape with one step, the material is negligibly strained at a portion corresponding to the punch bottom due to the frictional resistance whereas the material becomes extremely thin at a portion corresponding to a punch shoulder or a die shoulder and may be highly likely to be cracked. On the other hand, when a strain is introduced in advance at the preforming stage at a portion corresponding to the punch bottom in the final shape, the formability at the final forming stage can be simulatively improved.

Here, it is desirable that strain be uniformly introduced to the entirety. Thus, it is desirable to perform preforming with the forming method, such as hydraulic bulge forming, with which the strain resulting from is likely to be uniformly distributed. Preforming may instead be normal press working.

DETAILED DESCRIPTION OF EXEMPLARY EMBODIMENTS OF THE INVENTION

Figure 1:
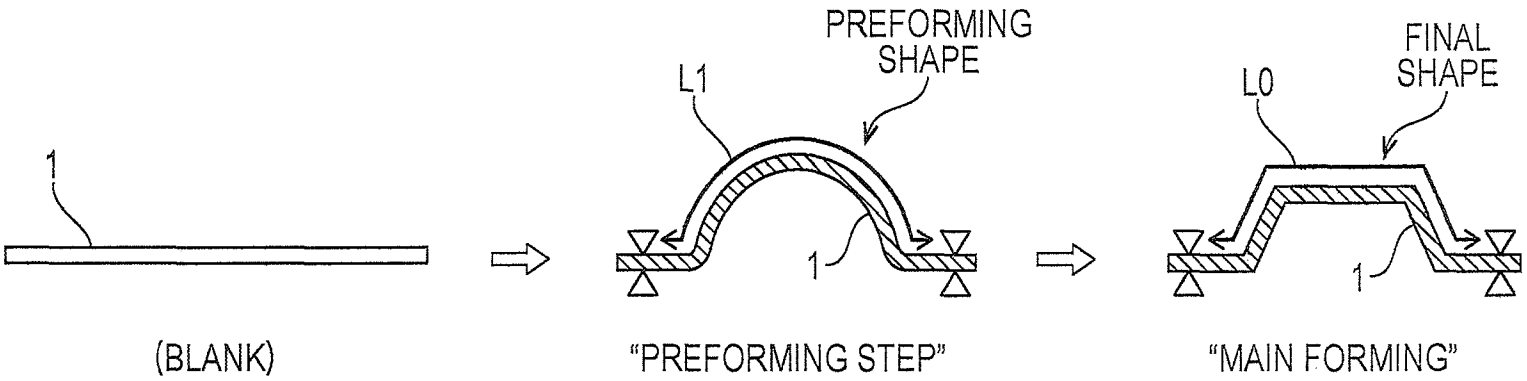
FIG. 1 is a schematic diagram illustrating a forming step according to an embodiment of the invention.

Referring now to the drawings, embodiments of the invention are described. The invention is not limited to the embodiments described below.

First Embodiment

FIG. 1 is a schematic diagram illustrating forming steps according to an embodiment.

As illustrated in FIG. 1, forming according to an embodiment includes two forming steps, that is, a preforming step, in which a blank 1 is plastically deformed into a preforming shape, and a main forming step, in which the blank 1 formed into the preforming shape in the preforming step is plastically deformed into a final shape to serve as a product. Here, the preforming step itself may have multiple preforming steps.

The preforming step is performed by, for example, press forming using a preforming die set for forming the blank 1 into the above-described preforming shape. The die set includes, for example, a set of a punch and a die.

Similarly, the main forming step is also performed by press forming using a main-forming die set for forming the blank 1 into the above-described final shape. The die set includes, for example, a set of a punch and a die.

The above-described press forming is, for example, stretch forming.

This embodiment includes, before performing the preforming step, a process of acquiring the shape of the preforming die set, that is, the preforming shape from the final shape. After the preforming shape is determined, the preforming die set is manufactured so as to have the determined preforming shape.

In a method for determining the preforming shape, the preforming shape is determined so that, after cross sections of the blank 1 having the final shape are taken at multiple positions along the thickness direction, the ratio of the cross-sectional line length in the preforming shape to the cross-sectional line length in the final shape at the same cross section position falls within a predetermined tolerance range. Specifically, the preforming shape is determined so that, after the cross-sectional line length in the final shape and the cross-sectional line length in the preforming shape are compared with each other, the ratio of one of the cross-sectional line length to the other cross-sectional line length falls within a predetermined tolerance range.

Here, the direction "parallel to the direction of the thickness of the blank 1" corresponds to the direction of pressing.

Figure 2:
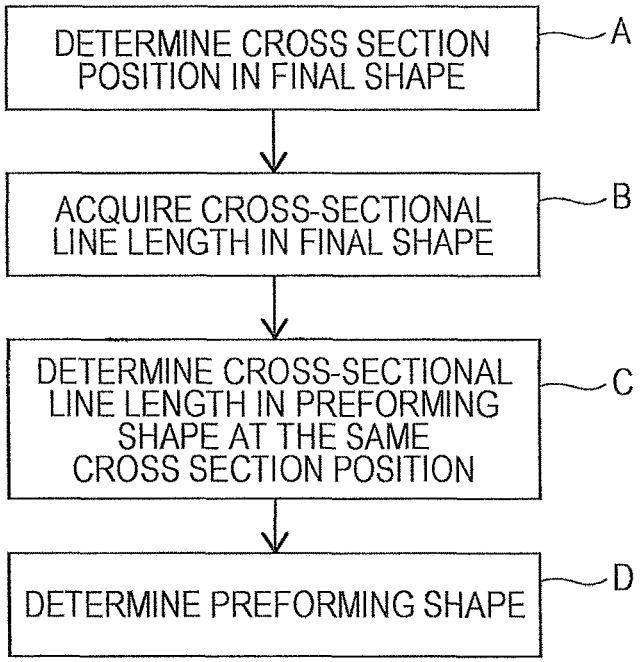
FIG. 2 is a flowchart relating to a first embodiment and illustrates a method for determining a preforming shape.

FIG. 2 illustrates an operation example performed by the method for determining a preforming shape on the basis of the final shape.

Specifically, two or more cross sections are determined in the blank 1 (step A). It is preferable to determine the cross sections at such positions that the cross sections pass characteristic portions in which the curvature of the cross-sectional shape in at least the final shape is steep. By determining the positions of cross sections at such positions, the number of cross sections that are determined can be kept small.

Figure 3:
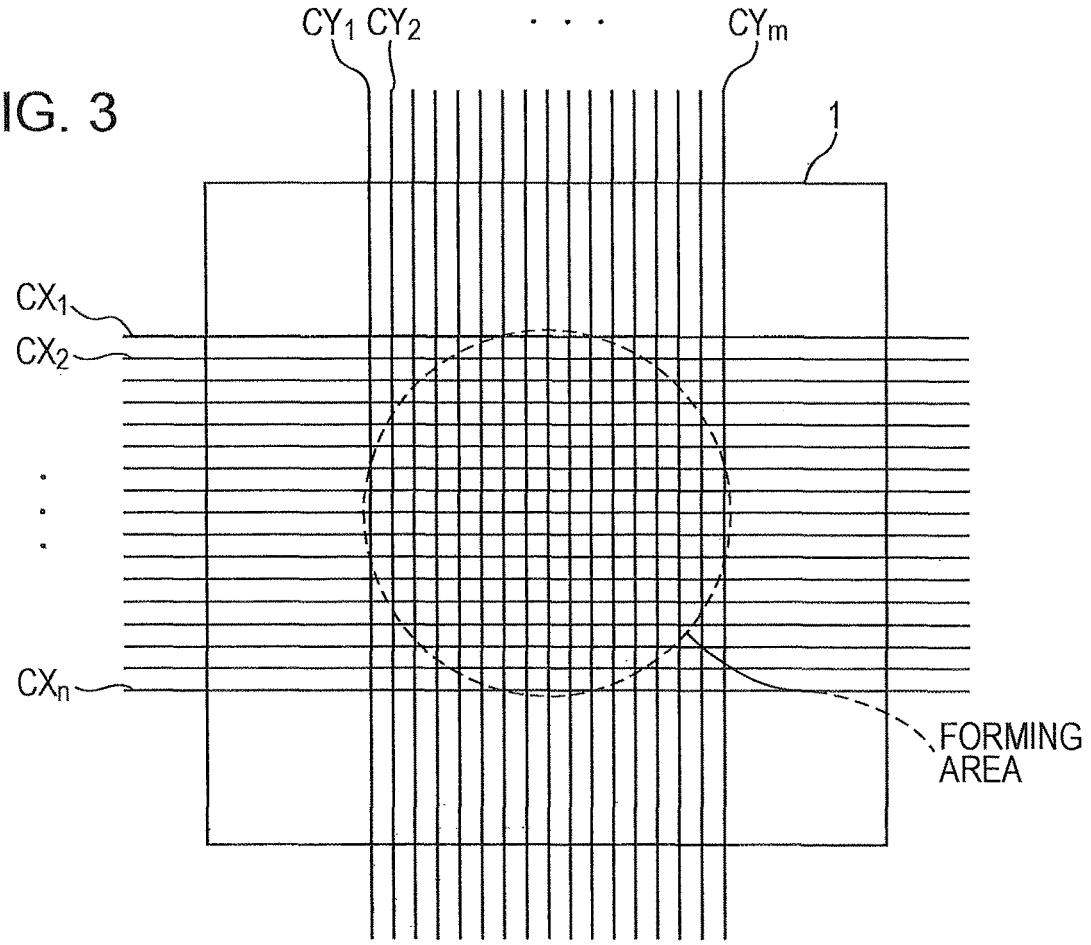
FIG. 3 is a diagram relating to the first embodiment and a top plan view of a first example of positions of multiple cross sections at each of which a cross-sectional line shape is acquired.

FIG. 3 illustrates a first example method for determining multiple positions of cross sections.

Specifically, the example illustrated in FIG. 3 is an example of the case where, as multiple positions of cross sections, cross sections are determined at (n+m) positions so as to be taken in an n×m grid-like form (in a mesh-like form) when viewed in a direction parallel to the thickness direction of the blank 1 before being subjected to forming (when viewed in a plan or viewed in the stretch forming direction in the forming). The determined positions are described below. The peripheral border line of the forming area corresponds to the outline of the final shape.

Subsequently, the cross-sectional line lengths at the multiple determined positions are calculated in the final shape (step B). The cross-sectional line length L0 in the final shape is acquired by performing final-shape forming simulation using, for example, computer aided engineering (CAE). Alternatively, the cross-sectional line length L0 in the final shape may be acquired by manufacturing a product having a final shape through actual press forming and measuring the cross-sectional line length L0 by, for example, a method of optical measurement. The method for acquiring the cross-sectional line length L0 is not limited to these and other publicly known methods may naturally be used.

Thereafter, a cross-sectional line length L1 in the preforming shape taken at each cross section is specified so that the cross-sectional line length L1 at the position the same as the cross section position determined in the final shape is equal to the cross-sectional line length corresponding to the acquired cross-sectional line length (Step C). At this time, the cross-sectional line length L1 at each cross section is determined so as to fall within, for example, a tolerance range, described below.

The cross-sectional line length corresponding to the cross-sectional line length is a cross-sectional line length acquired when the ratio of the cross-sectional line length in the preforming shape to the cross-sectional line length in the final shape falls within a predetermined tolerance range. In this embodiment, the predetermined tolerance range is the range within which (L1/L0) is 0.8 times or greater and 1.2 times or smaller. When this condition is satisfied, the cross-sectional line length in the final shape and the cross-sectional line length in the preforming shape in the same cross section approximate to each other.

Subsequently, the preforming shape is specified (Step D) so as to satisfy all the conditions of the cross-sectional line lengths L1 at the specified cross sections.

Here, in Step A described above, the accuracy improves with increasing number of cross sections at each of which the cross-sectional line length is acquired. Although the cross sections may be taken in any manner, it is preferable to take at least two cross sections.

Here, rectangular coordinates are assumed where the direction of the thickness of the blank 1 before being subjected to forming is defined as a Z axis and the directions orthogonal to the Z axis are defined as an X axis and a Y axis. The X axis and the Y axis here are directions parallel to the surface of the blank 1 before being subjected to forming.

In the first setting example method illustrated in FIG. 3, n cross sections are determined so as to be taken parallel to the XZ plane at predetermined intervals and m cross sections are determined so as to be taken parallel to the YZ plane at predetermined intervals. Here, n and m are one or greater.

When n and m are determined to be two or greater, the cross sections are determined so as to be taken in a grid-like form (meshed form) when viewed in the direction of the thickness of the blank 1 before being subjected to forming. Here, the grid-like form is not limited to an orthogonal grid-like form. The cross sections only have to be determined so as to be taken in at least two directions crossing each other when viewed in a plan and so as to include multiple cross-sectional shapes for each direction. when the direction of the thickness of the blank 1 before being subjected to forming and the direction of pressing are not parallel to each other, it is preferable that the direction of each section be parallel to the direction of pressing, not parallel to the Z axis.

As described above, it is preferable to select a cross section that passes a large number of portions at which the curvature in the final shape steeply changes to a predetermined extent or higher. The line for specifying the cross section is not limited to a straight line but is simpler when determined to be a straight line.

When the preforming shape is determined with cross sections taken in the two directions, the final shape of the preforming shape is determined by, for example, temporarily determining the preforming shape on the basis of the cross-sectional line shape in the direction in which the extent to which the curvature changes is smaller and then correcting the preforming shape on the basis of the cross-sectional line shape in the other direction.

It is preferable that the ratio of the cross-sectional line length in the preforming shape to the cross-sectional line length in the final shape fall within the above-described range of 0.8 times to 1.2 times and more preferable that the ratio fall within the range of 0.9 times to 1.1 times. It has been confirmed that, adjusting the ratio so as to fall within the range of 0.8 times to 1.2 times enables significant reduction of occurrences of cracks or wrinkles on the product surface. As it has been confirmed that high yields are securely acquired when the ratio is adjusted so as to fall within at least this range, these values are defined.

Here, the example illustrated in FIG. 3 is an example in which multiple cross sections are determined so as to be in a grid-like form. Multiple cross sections may be determined so as to be in other forms besides this form.

Figure 4:
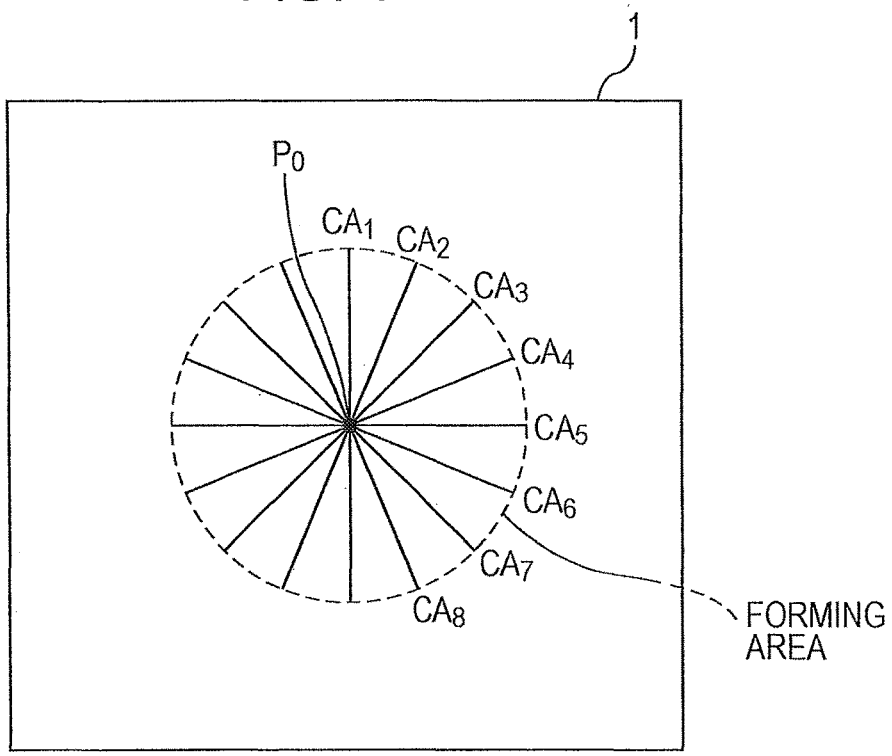
FIG. 4 is a diagram relating to the first embodiment and a top plan view of a second example of positions of multiple cross sections at each of which a cross-sectional line shape is acquired.

Subsequently, FIG. 4 illustrates a second setting example method for determining multiple positions of cross sections.

This is an example where the multiple positions of cross sections are determined so as to be in a radial form. Specifically, when viewed in the direction parallel to the direction of pressing (in the direction parallel to the direction of the thickness of the blank before being subjected to forming), an internal set point $P_0$ is determined within the forming area of the final shape, multiple lines $CA_1$ to $CA_8$ that pass the internal set point P0 and extend in directions different from one another are determined, and the multiple cross sections are determined at the positions of the determined multiple lines.

Although FIG. 4 illustrates the case where multiple lines are eight lines, the multiple lines may be other than eight lines. However, it is preferable that the number of cross sections be eight or greater. If the same level of accuracy is required, the number of cross sections can be kept smaller in the case of radially taking the cross sections than in the case of taking the cross sections in a grid-like form.

The radially extending lines do not have to be evenly spaced apart from one another. It is preferable that the radially extending lines be determined so as to pass portions at which the curvature changes to a large extent in the final shape.

Figure 7:
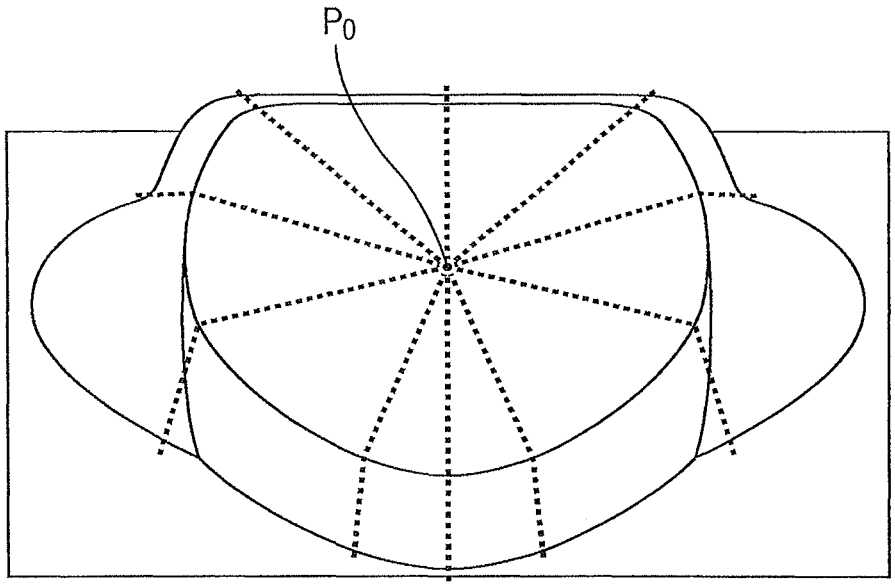
FIG. 7 is a diagram relating to the first embodiment and illustrates a final shape of Example 2.

FIG. 4 exemplarily illustrates the case of using, as a single line, a straight line that passes through the internal set point P0 and has both ends arriving at the peripheral border line of the forming area of the final shape. However, as illustrated in FIG. 7, described below, each line may be determined so as to connect the internal set point P0 to a single point on the peripheral border line of the forming area of the final shape. In this case, the lines in the example of FIG. 4 are regarded as 16 lines. Here, the "forming area" expresses an area of a pressed product subjected to preforming or main forming over which plastic deformation has been actively provided, the area including the product surface and excess metal. The area, however, does not include a portion formed with a bead.

It is preferable to determine the internal set point P0 at the centroid position of the forming area when the forming area is viewed from the direction parallel to the direction of pressing.

Here, the above description has been given taking a case, as an example, where a blank is formed into the final shape with two forming steps including a preforming step and a main forming step. The preforming step may include two or more provisional forming steps.

In this case, it is preferable that, in each of the multiple cross sections in the final shape, a ratio of the cross-sectional line length in the process shape acquired after being subjected to each provisional forming step with respect to the cross-sectional line length in the final shape in the same cross section be determined for each provisional forming step so as to fall within the above-described tolerance range. However, it suffices if the preforming shape acquired in the step preceding the forming into the final shape satisfies the above-described conditions.

Aspects of the invention are applicable to all the different types of press forming of the blank 1 not only automobile parts. The material subjected to press forming is not limited to steel. Aspects of the invention are also applicable to iron alloys such as stainless steel, nonferrous materials, or non-metal materials.

Aspects of the invention are also particularly applicable to other materials such as a high-tensile steel material, which has been difficult to be process.

Second Embodiment

FIG. 1 (the same as FIG. 1 used for illustrating the first embodiment) is a schematic diagram illustrating the forming step according to this embodiment.

As illustrated in FIG. 1, forming according to this embodiment includes two forming steps, that is, a preforming step, in which a blank 1 is plastically deformed into a preforming shape, and a main forming step, in which the blank 1 formed into the preforming shape in the preforming step is plastically deformed into a final shape to serve as a product. Here, the preforming step itself may have multiple preforming steps.

The preforming step is performed by, for example, press forming using a preforming die set for forming the blank 1 into the above-described preforming shape. The die set includes, for example, a set of a punch and a die.

Similarly, the main forming step is also performed by press forming using a main-forming die set for forming the blank 1 into the above-described final shape. The die set includes, for example, a set of a punch and a die.

The above-described press forming is, for example, stretch forming.

This embodiment includes, before performing the preforming step, a process of acquiring the shape of the preforming die set, that is, the preforming shape from the final shape. After the preforming shape is determined, the preforming die set is manufactured so as to have the determined preforming shape.

A method for determining the preforming shape includes determining the preforming shape so that a ratio of a second line length to a first line length falls within a predetermined tolerance range. An internal reference point is determined in a forming area of the final shape and a plurality of external reference points are determined on a peripheral border line of the forming area. In the final shape, a plurality of cross-sectional lines individually connecting a first internal point corresponding to the internal reference point to first external points corresponding to the external reference points are determined, division points at which the determined cross-sectional lines are divided at a predetermined set ratio are calculated, and a length of an endless annular line formed by connecting adjacent ones of the division points together is determined as the first line length. In the preforming shape, a length of an endless annular line formed by connecting together adjacent ones of division points, at which a plurality of cross sections are divided at the predetermined set ratio, are determined as the second line length, the plurality of cross sections individually connecting a second internal point corresponding to the internal reference point and second external points corresponding to the external reference points. Now, the method for determining external points in the preforming shape is described. The internal reference point determined in the final shape is defined as an original point and the direction of pressing is defined as the Z direction. Three-dimensional coordinates are determined in which the directions that are orthogonal to the Z direction and in which two straight lines, which pass the original point and are orthogonal to each other, are directed are defined as an X direction and a Y direction. Thus, each external reference point is allowed to be expressed using the X, Y, and Z coordinates. Subsequently, the X, Y, and Z coordinates are similarly defined in the space in which the preforming shape is designed and the coordinates of each external reference point acquired in the above-described manner are referred. Thus, each external reference point in the space in which the preforming shape is designed can be acquired.

Specifically, the preforming shape is determined so that, after a contour-line-like (annual-ring-like) endless annular line is determined around the first internal point in the final shape and the first line length of the endless annular line is acquired, the ratio of a second line length of an endless annular line in the final shape corresponding to the endless annular line in the preforming shape to the first line length falls within a predetermined tolerance range. It is preferable that a cross-sectional line in each shape be adopted as an endless annular line.

Figure 9:
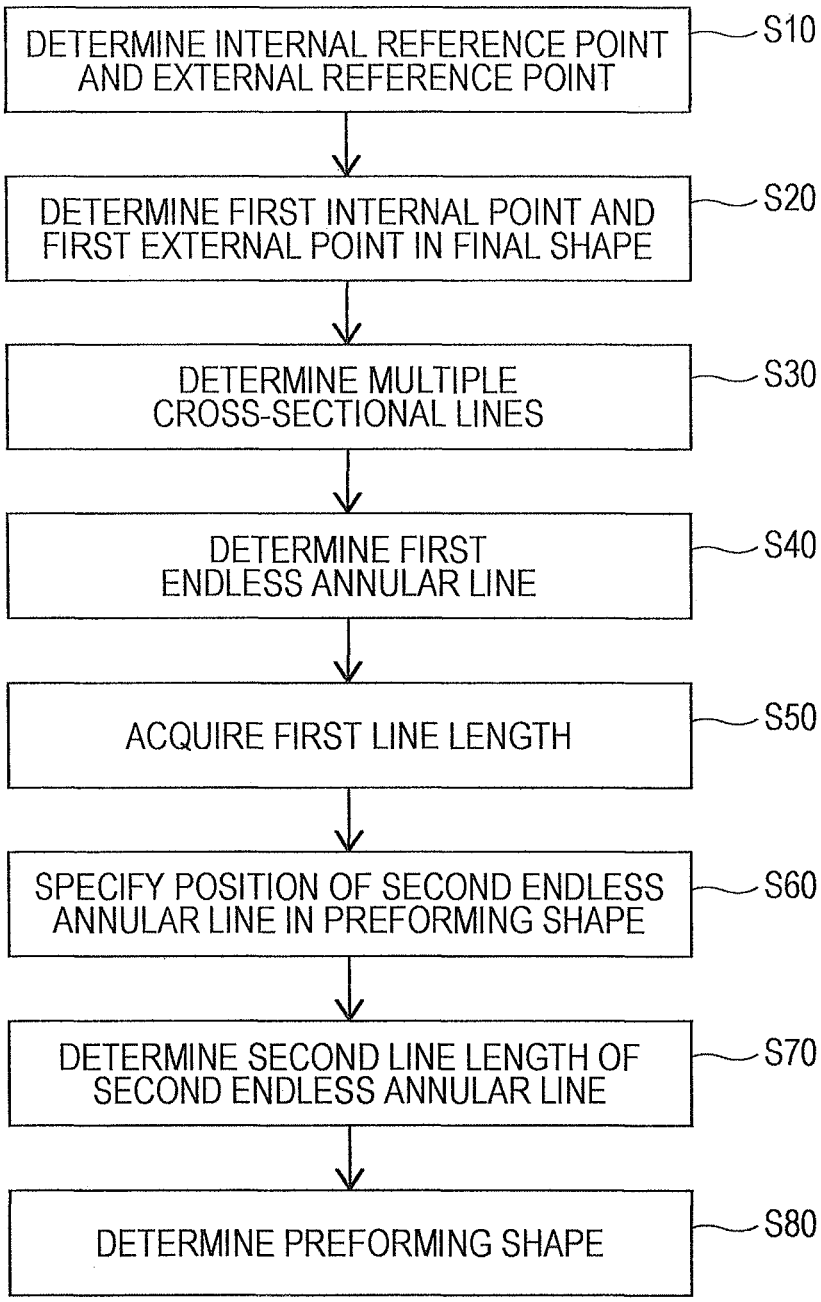
FIG. 9 is a flowchart relating to a second embodiment and illustrates a method for determining a preforming shape.

FIG. 9 illustrates an operation example of a method for determining the preforming shape based on the final shape.

Figure 10:
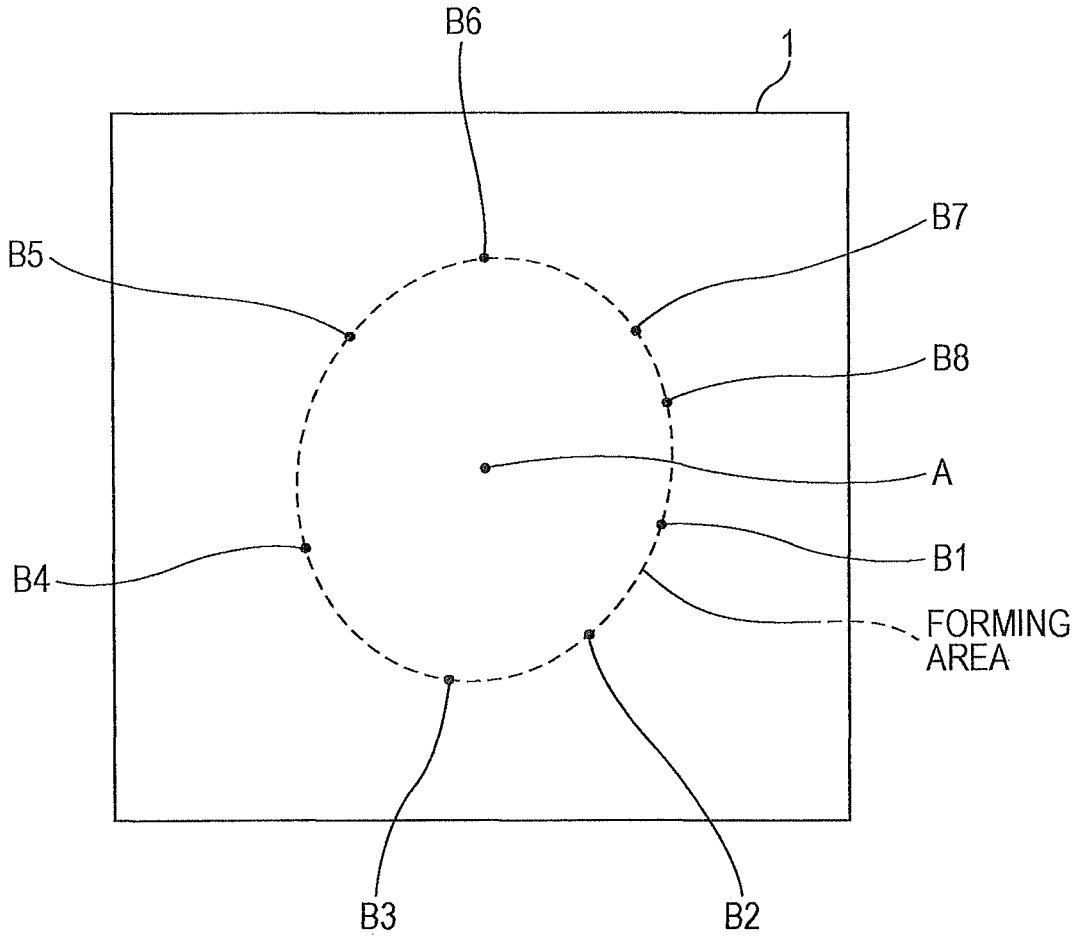
FIG. 10 is a diagram relating to the second embodiment and a top plan view of a setting example of an internal reference point and external reference points.

Firstly in Step S10, as illustrated in FIG. 10, an internal reference point A is determined within a forming area of a blank 1 before being subjected to forming that is to form the final shape. At the same time, multiple external reference points B1 to B8 are determined on the peripheral border line of the forming area.

The internal reference point A is determined at, for example, the position of the centroid of the forming area of the blank 1 before being subjected to forming that is to form the final shape or the position of the centroid of the blank 1 formed into the final shape when the blank 1 in the final shape is viewed from the direction parallel to the direction of pressing.

The multiple external reference points B1 to B8 are determined on the peripheral border line of the forming area along the peripheral border line of the forming area. The multiple external reference points B1 to B8 do not have to be evenly spaced apart from one another.

This embodiment exemplarily illustrates a case where the positions of the multiple external reference points B1 to B8 are determined on the blank 1 before being subjected to forming. However, it is preferable to determine the positions of the multiple external reference points B1 to B8 on the peripheral border line (outline) of the forming area of the blank 1 subjected to final forming and to determine the positions corresponding to the positions of the multiple external reference points B1 to B8 on the blank 1 before being subjected to forming.

By determining the positions of the multiple external reference points B1 to B8 on the peripheral border line (outline) of the forming area of the blank 1 subjected to final forming, the external reference points B1 to B8 can be determined at more appropriate positions. Specifically, by determining the external reference points B1 to B8 at such positions that cross sections pass portions at which the curvature changes to a large extent (for example, steep positions), the accuracy can be improved while the number of the external reference points B1 to B8 is kept low.

The accuracy improves with increasing number of external reference points. It is preferable that the number of external reference points be four or greater.

Figure 11:
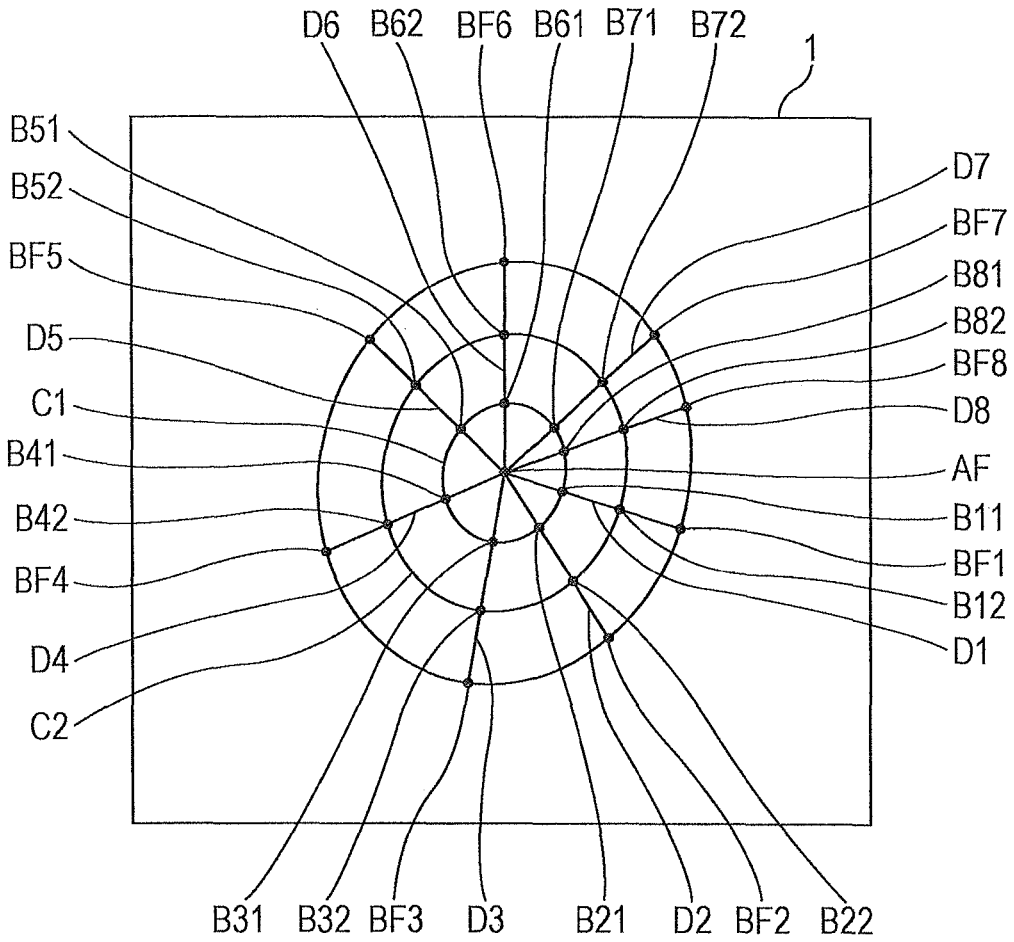
FIG. 11 is a diagram relating to the second embodiment and illustrates how endless annular lines (first endless annular lines) in a final shape are determined.
Figure 11:
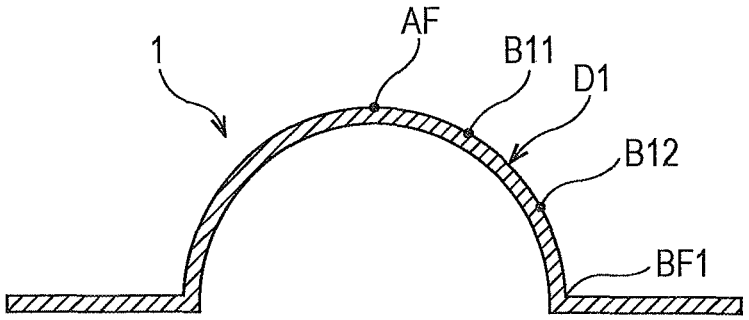

Subsequently, as illustrated in FIG. 11(*a*), which is a schematic top plan view, a first internal point AF corresponding to the internal reference point A and first external points BF1 to BF8 corresponding to the external reference points B1 to B8 are determined in the final shape (Step S20) and the positions of the cross-sectional lines D1 to D7 in the final shape that connect the first internal point AF to the respective first external points BF1 to BF8 are determined (Step S30).

Subsequently, in Step S40, as illustrated in FIG. 11, in the cross-sectional lines D1 to D7, division points B11 to B82 at which the actual lengths of the cross-sectional lines are divided at set ratios are determined. In this example, two ratios have been determined. Thus, two of division points B11 to B82 are determined at each of the cross-sectional lines D1 to D7. The accuracy improves with increasing number of set ratios. However, increasing set ratios increases the costs for calculation and time taken for design. A preferable number of set ratios is four.

Subsequently, the cross-sectional lines in the final shape that pass all the division points B11 to B82 corresponding to the set ratios are determined as first endless annular lines C1 and C2. At this time, for example, a line whose distance between adjacent two of the division points B11 to B82 is shortest is adopted. Alternatively, instead of the cross-sectional lines, the first endless annular lines C1 and C2 may be endless annular lines formed by connecting adjacent two of the division points B11 to B82 with straight lines. Nevertheless, the accuracy is higher in the case of adopting the cross-sectional lines.

Subsequently, in Step S50, first line lengths of each first endless annular line for the respective ratios set in Step S40 are calculated. In this example, two first line lengths are acquired.

The first line lengths in the final shape are acquired by performing final-shape forming simulation using, for example, CAE. Alternatively, for example, the first line lengths may be measured with an optical measurement as a result of manufacturing a product having a final shape through actual press forming.

Figure 12:
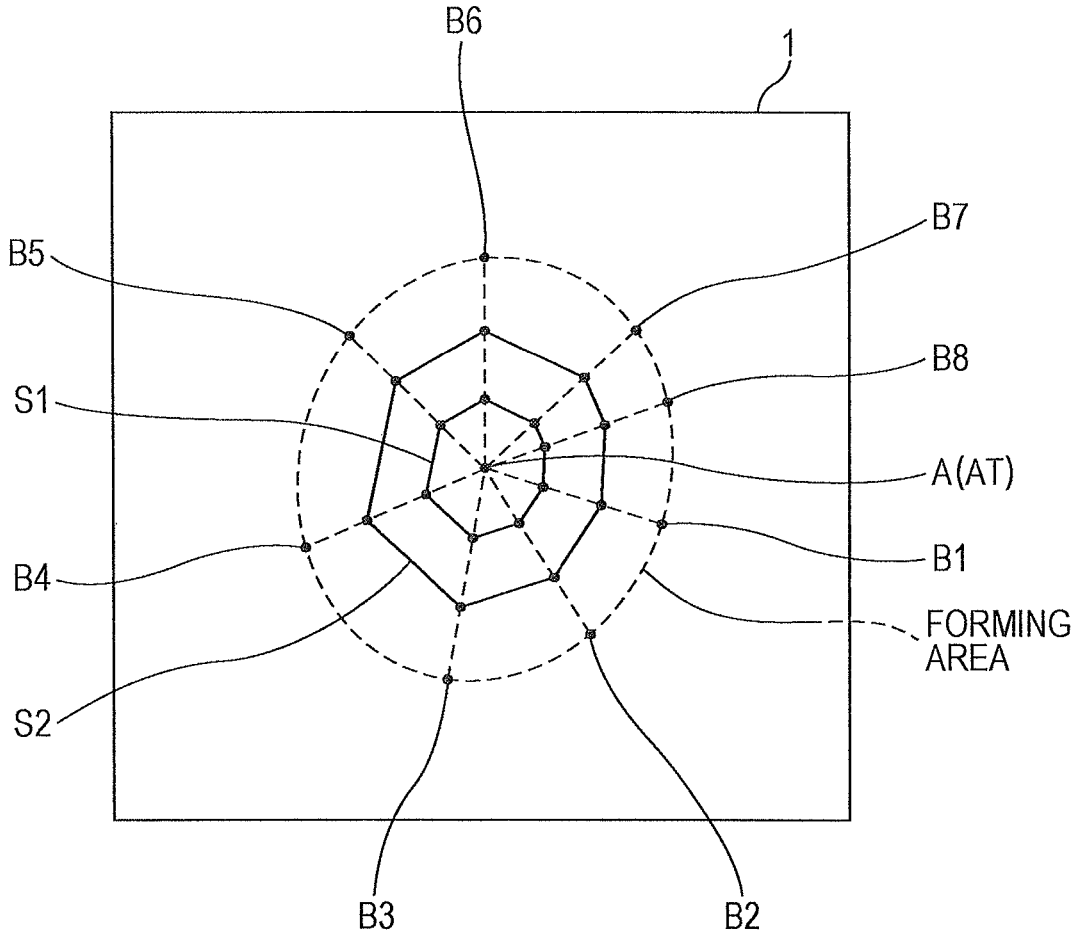
FIG. 12 is a diagram relating to the second embodiment and illustrates the positions of endless annular lines (second endless annular line) in a preforming shape.

Subsequently in Step S60, as illustrated in FIG. 12, straight lines that connect the internal reference point A (corresponding to the second internal point) to the respective external reference points B1 to B8 in the blank 1 before being subjected to forming are determined as the positions of the cross-sectional lines D1 to D7 in the preforming shape and the division points B11 to B82 are determined by dividing the straight lines at the set ratios used in the final shape. Then, the position of the endless annular line that connects adjacent ones of the division points B11 to B82 for each set ratio with a straight line is specified as the position of the second endless annular line in the preforming shape.

In Step S70, the second line length for each set ratio is acquired from the first line length for the corresponding set ratio acquired in Step S50. Specifically, the second line length for each set ratio is determined within the range of 0.8 times to 1.2 times as long as the first line length.

Subsequently, in Step S80, the shape in which the portion serving as the second endless annular line in the preforming shape determined in Step S60 has a length equal to the second line length determined in Step S70 is determined as a preforming shape.

When the lengths of the portions of multiple second endless annular lines are to be determined, a final preforming shape is determined by, for example, temporarily determining the preforming shape on the basis of a portion including a portion in which the curvature changes to a larger extent in the final shape and then correcting the length of the portions of other second endless annular lines.

Here, it is preferable that the ratio of the second line length to the first line length be 0.6 times to 1.4 times and, as described above, more preferable that the ratio be within the range of 0.8 times to 1.2 times. It is most preferable that the ratio be within the range of 0.9 times to 1.1 times. If the ratio falls below 0.6 times, the line length may be insufficient at final forming, whereby cracks or yields reduction may occur. If, on the other hand, the ratio exceeds 1.4 times, the line length may be excessive at final forming, whereby wrinkles may occur on the product surface. In contrast, it has been confirmed that adjusting the ratio to the range of 0.8 times to 1.2 times enables significant reduction of cracks or wrinkles on the product surface. Specifically, the boundary values of the range of 0.8 times to 1.2 times are not critical values. Since it has been confirmed that high yields are securely acquired at least in the case where the ratio falls within this range, these values are determined.

In the above description, the case where a blank is formed into a final shape with two forming steps including a preforming step and a main forming step has been described as an example. Here, the preforming step may include two or more provisional forming steps.

In this case, it is preferable that the process shape acquired after being subjected to each provisional forming step be determined for each provisional forming step so that the first endless annular lines C1 and C2 in the final shape and the second endless annular line in the process shape after being subjected to the forming step fall within the above-described tolerance range. However, it suffices if the preforming shape acquired in the step preceding the forming into the final shape satisfies the above-described conditions.

Aspects of the invention are applicable to all the different types of press forming of the blank 1 not only automobile parts. The material subjected to press forming is not limited to steel. Aspects of the invention are also applicable to iron alloys such as stainless steel, nonferrous materials, or non-metal materials.

Aspects of the invention are also particularly applicable to other materials such as a high-tensile steel material, which has been difficult to be process.

Example

Examples of the First Exemplary Embodiment of the Invention

Example 1

Example 1 described below is an example in which cross sections at each of which the cross-sectional line length is adjusted are determined to be taken in a grid-like form.

Figure 5:
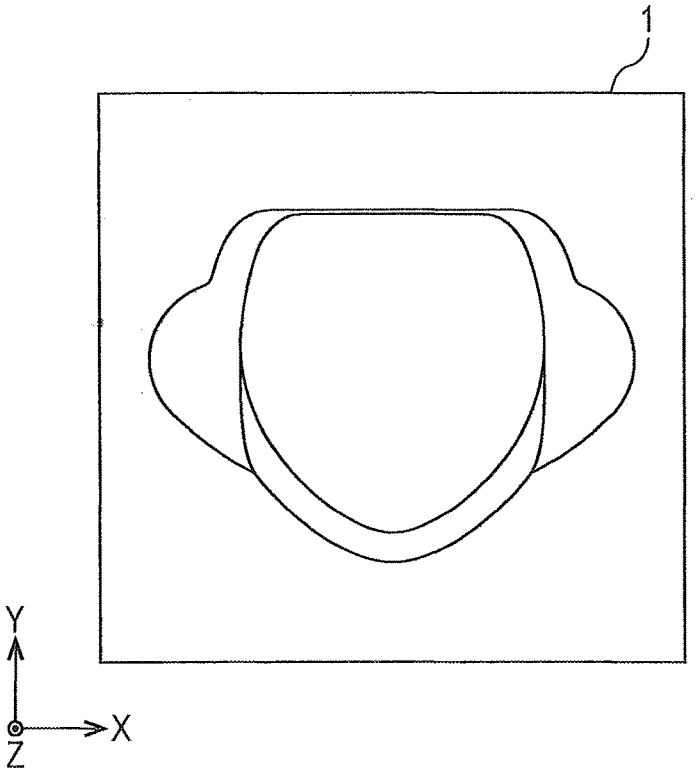
FIG. 5 is a diagram relating to the first embodiment and illustrates a final shape of Example 1.

The final shape designed after an automobile wheelhouse part illustrated in FIG. 5 was fabricated with multiple steps in the press forming process.

A mild steel sheet having a thickness of 0.7 mm was used as a blank 1. Lockbeads were provided on the outer periphery of the portion at which a product is formed and complete stretch forming was performed to verify the effects of aspects of the invention.

Figure 6:
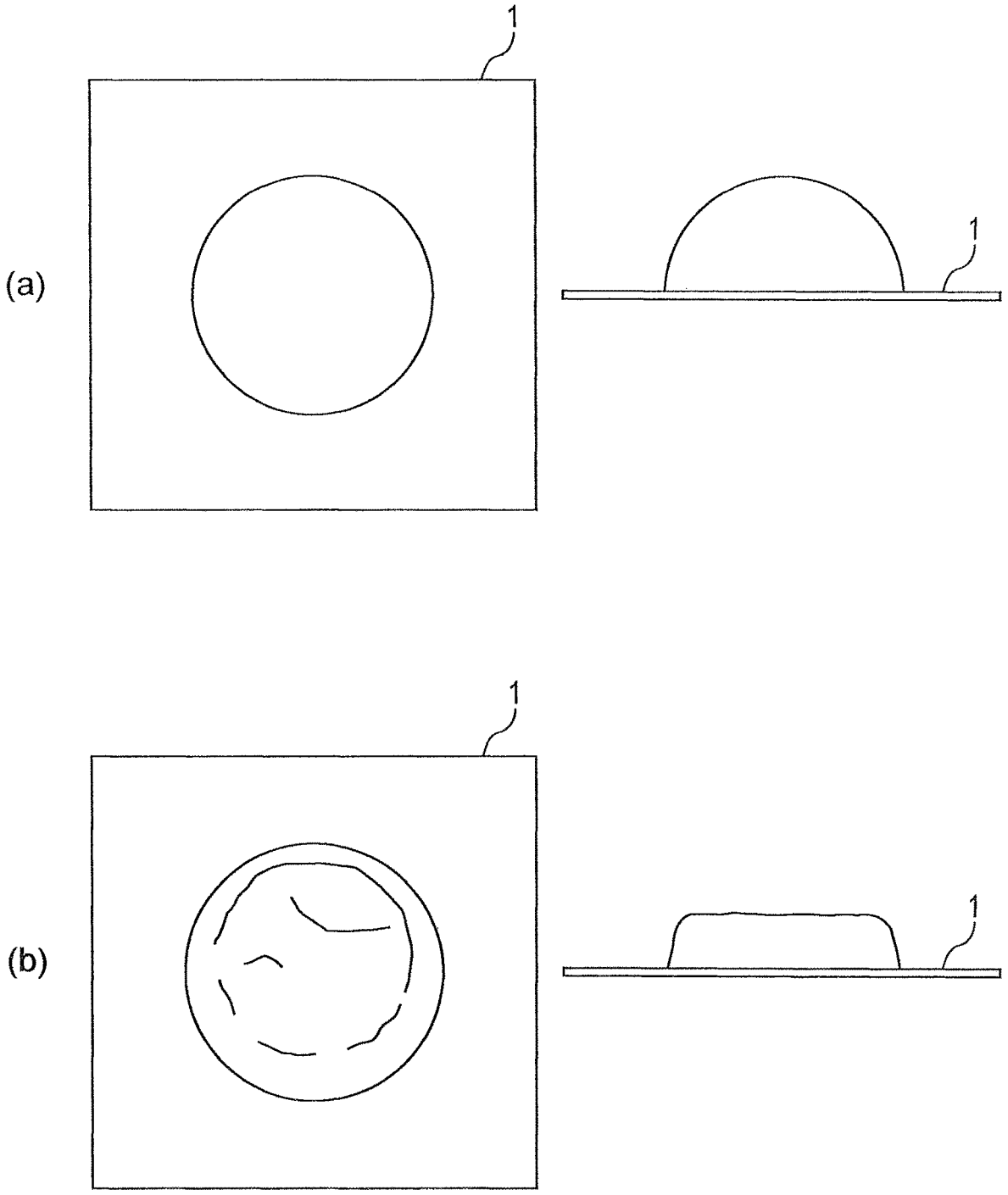
FIG. 6 is a diagram relating to the first embodiment and illustrates a preforming shape of Example 1, where FIG. 6(*a*) illustrates an example of a shape resulting from an existing method whereas FIG. 6(*b*) illustrates an example of a shape resulting from the method according to aspects of the invention.

For comparison, FIG. 6(*a*) illustrates a preforming shape that has been typically formed. The preforming shape used for comparison (FIG. 6(*a*)) is a preforming shape formed by stretch forming the sheet in a shape having a round head without using the method according to aspects of the invention. The preforming shape used for comparison is formed into a hemispheric shape.

FIG. 6(*b*) illustrates a preforming shape acquired by the method according to aspects of the invention. This preforming shape is a shape having a slightly recessed center portion so as to satisfy the conditions of the acquired cross-sectional line lengths.

Here, in determination of the preforming shape according to aspects of the invention, a final shape forming analysis was performed using an analytic model and a preforming punch shape (preforming shape) was calculated from the result of the analysis.

The mesh size of the analytic model was determined as 5 mm and the die set was a rigid body. The forming analysis was performed by a dynamic explicit method using LS-DYNA version 9.7.1R5. As illustrated in FIG. 3, in the above-described coordinate system, 60 cross sections were taken in the XZ plane and 60 cross sections were taken in the YZ plane, 120 cross sections were taken in total, as cross sections for acquiring the preforming shape. The preforming shape was designed by defining the above-described coordinate system in the space in which the preforming shape is designed, determining 60 cross sections each in the XZ plane and the YZ plane, 120 cross sections in total, at the same coordinates as those of the above-described 120 cross sections, and determining the ratio of the cross-sectional line length in the preforming shape to the cross-sectional line length in the final shape at the respective cross section positions so that the ratio falls within the range of 0.8 times to 1.2 times. At this time, the shape was calculated in such a state that the outlines of the preforming stretch forming in a round head used for comparison and the preforming shape according to the example coincide with each other in a top view.

Table 1 shows the results of experiments.

TABLE 1

| Method | Cracks | Wrinkles |
|---|---|---|
| Existing Method (Single Forming) | Occurred | Not Occurred |
| Existing Method (Preforming in Round Head) | Dangerous | Occurred |
| Method According to Aspects of Invention | Not Occurred | Not Occurred |

As found from Table 1, in the case of manufacture with single forming without performing preforming, cracks occurred as a result of strain being localized on a portion corresponding to a die shoulder. In the case of designing the preforming shape without the method according to aspects of the invention, significant wrinkles occurred at a portion corresponding to the punch bottom and necking occurred at a portion corresponding to the punch shoulder since the cross-sectional line length was not taken into consideration. In contrast, it was confirmed that none of wrinkles, cracks, necking, and other problems occurred in the case where the preforming shape was determined by the method according to aspects of the invention. In this manner, preferable results can be acquired by providing the method according to aspects of the invention.

Example 2

Example 2 is an example in which cross sections at each of which the cross-sectional line length is adjusted are determined so as to be in a radial form.

In Example 2, an internal set point P0 is determined in the final shape acquired using the analytic model at the centroid position of the final shape when the final shape is viewed from the direction parallel to the direction of pressing, as illustrated in FIG. 7. Multiple lines are determined so as to extend radially from the internal set point P0. The positions of broken lines indicate the positions of the multiple lines.

Figure 8:
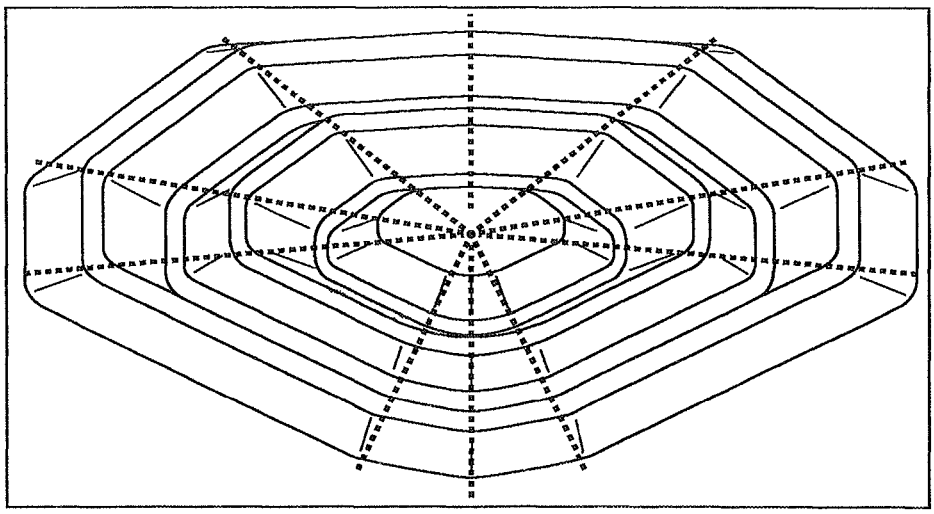
FIG. 8 is a diagram relating to the first embodiment and illustrates a preforming shape of Example 2.

Subsequently, on the basis of the cross-sectional line lengths at the determined positions of the multiple lines, the ratio of the cross-sectional line length in the preforming shape to the cross-sectional line length in the final shape was calculated so as to fall within 0.8 times to 1.2 times at each cross section position. FIG. 8 illustrates the shape subjected to preforming on the basis of the results. The positions of the broken lines indicate the positions of the cross-sectional line lengths.

Here, properties other than the cross section positions, such as those of a blank or a final shape, are similarly determined as in the case of Example 1.

Also in Example 2, it was confirmed that none of wrinkles, cracks, necking, and other problems occurred. In this manner, preferable results can be also acquired by providing this method according to aspects of the invention.

Examples of the Second Exemplary Embodiment of the Invention

Figure 13:
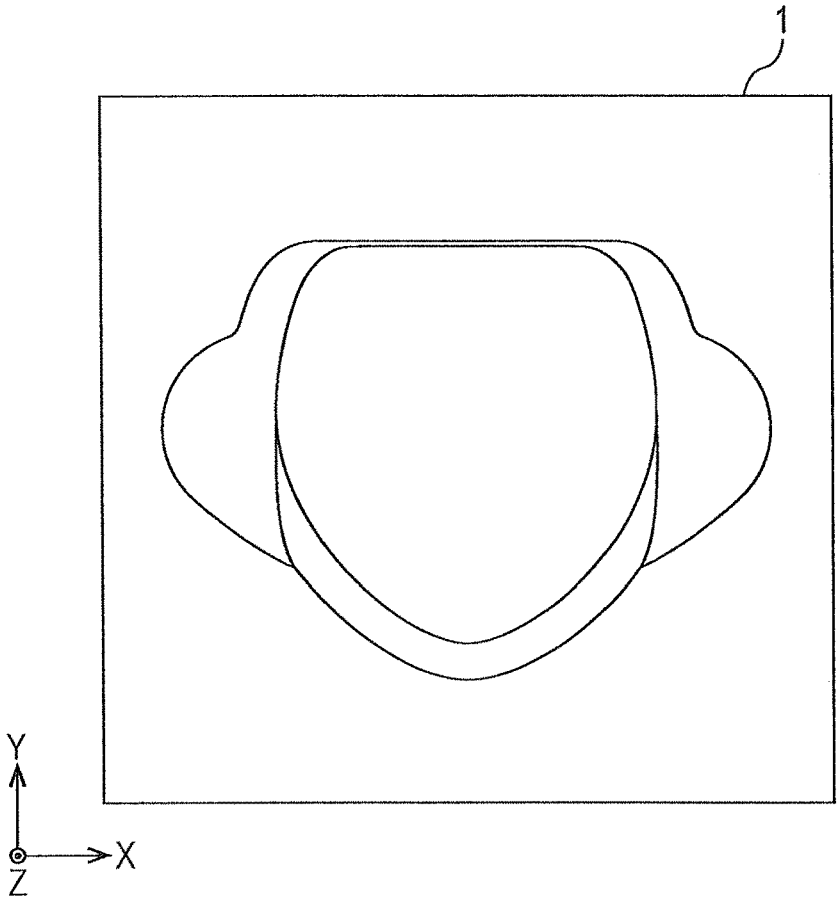
FIG. 13 is a diagram relating to the second embodiment and illustrates a final shape of Example.

The final shape designed after an automobile wheelhouse part illustrated in FIG. 13 was fabricated with multiple steps in the press forming process.

A mild steel sheet having a thickness of 0.7 mm was used as a blank 1. Lockbeads were provided on the outer periphery of the portion at which a product is formed and complete stretch forming was performed to verify the effects of aspects of the invention.

Figure 14:
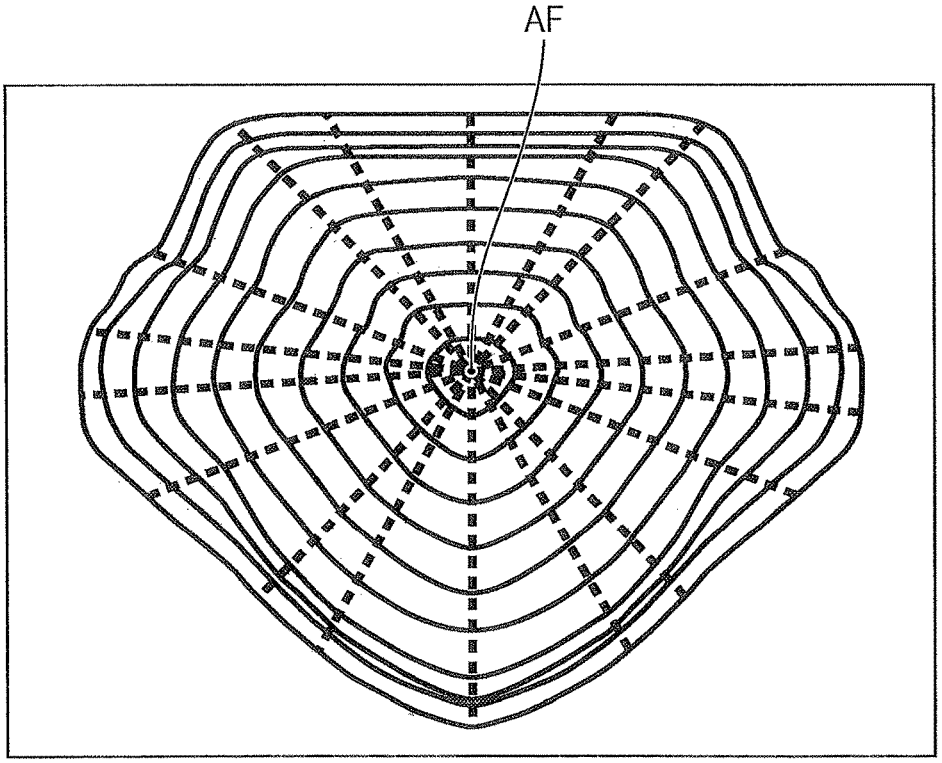
FIG. 14 is a diagram relating to the second embodiment and a top plan view of endless annular lines (first endless annular lines) of a final shape of Example.

The internal reference point was determined at the centroid position in the final shape, multiple points were disposed on the peripheral border line (outline) of the forming area of the final shape, division points, at which each of cross-sectional lines individually connects the internal reference point to the corresponding multiple points, are determined at such positions that the corresponding one of the cross-sectional lines is divided into ten equal parts at the division points, and nine cross-sectional lines (first endless annular lines) were determined in accordance with the division positions (see FIG. 14).

Figure 15:
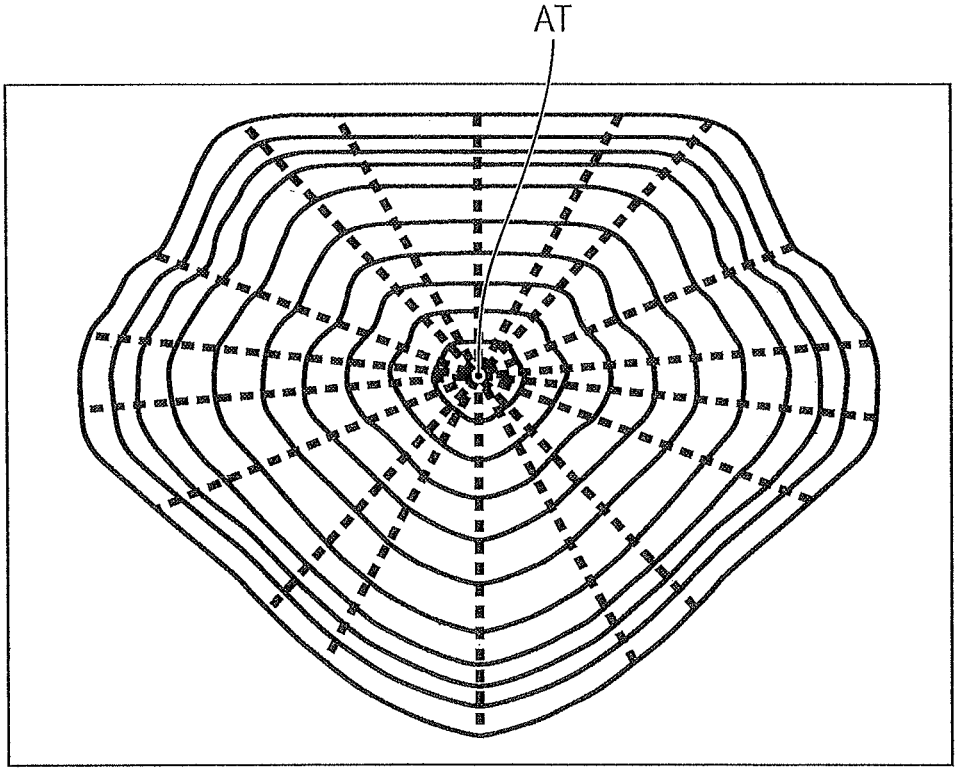
FIG. 15 is a diagram relating to the second embodiment and a top plan view of endless annular lines (second endless annular lines) of a preforming shape of Example.

Subsequently, the preforming shape was designed so that the line lengths at the nine cross-sectional line positions fall within 0.8 times to 1.2 times as long as the lengths in the final shape. FIG. 15 illustrates an example of the preforming shape.

Here, when the preforming shape was determined in accordance with aspects of the invention, a final shape forming analysis was performed using an analytic model and a preforming punch shape (preforming shape) was calculated from the result of the analysis.

For comparison, processing into a final shape was performed with a single forming without performing preforming.

Table 2 shows the results of experiments.

TABLE 2

| Method | Cracks | Wrinkles |
|---|---|---|
| Existing Method (Single Forming) | Occurred | Not Occurred |
| Method According to Aspects of Invention | Not Occurred | Not Occurred |

As found from Table 2, in the case of manufacture with single forming without performing preforming, cracks occurred as a result of strain being localized on a portion corresponding to a die shoulder. In the case of designing the preforming shape without the method according to aspects of the invention, significant wrinkles occurred at a portion corresponding to the punch bottom and necking occurred at a portion corresponding to the punch shoulder since the cross-sectional line length was not taken into consideration.

In contrast, it was confirmed that none of wrinkles, cracks, necking, and other problems occurred in the case where the preforming shape was determined by the method according to aspects of the invention. In this manner, preferable results can be acquired by providing the method according to aspects of the invention.

REFERENCE SIGNS LIST

1 blank 1
P0 internal set point
A internal reference point
AF internal point
B11 to B82 division point
B1 to B8 external reference point
BF1 to BF8 external point
C1, C2 first endless annular line
D1 to D7 cross-sectional line

The invention claimed is:

1. A method for forming a blank, comprising:

predetermining a tolerance range for a ratio of a theoretical line length in a preforming shape of the blank to a theoretical line length in a final shape of the blank;

determining a preforming shape having a set of theoretical cross sections taken at a theoretical plurality of positions in the preforming shape, a ratio of a length of one of the theoretical cross sections in the preforming shape to a length of a same theoretical cross section in the final shape falling within the predetermined tolerance range;

after determining the preforming shape, forming the blank into the preforming shape by plastic deformation; and plastically deforming the formed blank into the final shape from the preforming shape.

2. The method for forming a blank according to claim 1, wherein the predetermined tolerance range is a range of 0.8 times to 1.2 times.

3. The method for forming a blank according to claim 1, wherein the theoretical plurality of positions at which the theoretical cross sections are taken are determined so as to be in a grid form when viewed in a direction parallel to a direction of a thickness of the blank before being subjected to forming.

4. The method for forming a blank according to claim 1, wherein an internal set point is determined, the set of theoretical cross sections are taken along a plurality of theoretical lines that pass the internal set point and extend in directions different from one another.

5. The method for forming a blank according to claim 4, wherein the internal set point is determined at a centroid position of the final shape when the final shape is viewed from a direction parallel to a direction of a thickness of the blank before being subjected to forming.

6. The method for forming a blank according to claim 1, wherein forming into the preforming shape includes at least two provisional forming steps, and a processing shape acquired after performing each provisional forming step is determined so that, in each of the theoretical cross sections, a ratio of a cross-sectional line length in one of the theoretical cross sections in the processing shape acquired after the provisional forming step with respect to a cross-sectional line length in the same theoretical cross section in the final shape falls within a predetermined tolerance range.

7. The method for forming a blank according to claim 1, wherein the forming is press forming.

8. A computer aided method for determining a preforming shape of a blank, the method comprising:

determining with a computer the preforming shape so that, for a set of theoretical cross sections taken at a theoretical plurality of positions in the preforming shape and a final shape, a ratio of a length of one of the theoretical cross sections in the preforming shape to a length of the same theoretical cross section in the final shape falls within a predetermined tolerance range, to enable the blank, after being formed into the preforming shape by plastic deformation, to be plastically deformed into the final shape from the preforming shape.

9. The computer aided method for determining a preforming shape according to claim 8, wherein the plurality of positions at which the theoretical cross sections are taken are determined so as to be in a grid form.

10. The computer aided method for determining a preforming shape according to claim 8, wherein the plurality of positions at which the theoretical cross sections are taken are determined so as to be in a radial form.

* * * * *